US010062306B2

(12) United States Patent
Komatsubara et al.

(10) Patent No.: US 10,062,306 B2
(45) Date of Patent: Aug. 28, 2018

(54) DISPLAY TOOL

(71) Applicant: Panasonic Intellectual Property Management Co., Ltd., Osaka (JP)

(72) Inventors: Hiroyuki Komatsubara, Kyoto (JP); Akira Miki, Nara (JP); Yuki Ootomo, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/579,293

(22) PCT Filed: Jun. 1, 2016

(86) PCT No.: PCT/JP2016/002646
§ 371 (c)(1),
(2) Date: Dec. 4, 2017

(87) PCT Pub. No.: WO2017/002303
PCT Pub. Date: Jan. 5, 2017

(65) Prior Publication Data

US 2018/0165994 A1 Jun. 14, 2018

(30) Foreign Application Priority Data

Jun. 30, 2015 (JP) ..... 2015-131697

(51) Int. Cl.
*G09F 1/00* (2006.01)
*G09F 1/06* (2006.01)
(Continued)

(52) U.S. Cl.
CPC ..... *G09F 1/06* (2013.01); *A47F 5/10* (2013.01); *G09F 1/14* (2013.01)

(58) Field of Classification Search
CPC ..... G09F 1/06; G09F 1/14; A47F 5/10; A47F 5/11
(Continued)

(56) References Cited

U.S. PATENT DOCUMENTS 1,685,571 A * 9/1928 Meller ..... G09F 1/06 40/124.14
1,687,875 A * 10/1928 Meller ..... G09F 1/06 40/124.14
(Continued)

FOREIGN PATENT DOCUMENTS

JP 60-098474 U 7/1985

OTHER PUBLICATIONS

International Search Report of PCT application No. PCT/JP2016/002646 dated Jul. 26, 2016.
(Continued)

*Primary Examiner* — Joanne Silbermann
(74) *Attorney, Agent, or Firm* — McDermott Will & Emery LLP

(57) ABSTRACT

A display tool includes a display part, a back part, a stable part, a leg part, and a bottom part. The display part is disposed in its erected state. The back part has its upper edge connected to an upper edge of the display part and is disposed behind the display part such that a distance between the back part and the display part gradually increases from the upper edges to lower edges of the back part and the display part. The stable part protrudes downwardly along the back part from a portion of the lower edge of the back part. The leg part protrudes downward direction from the remaining portion of the lower edge of the back part at an angle less than an angle at which the back part slants. The bottom part is connected to a lower edge of the display part and to a lower edge of the leg part. The stable part is disposed such that its lower edge is in abutment with an upper surface of the bottom part.

7 Claims, 4 Drawing Sheets

(51) Int. Cl.
*G09F 1/14* (2006.01)
*A47F 5/10* (2006.01)

(58) Field of Classification Search
USPC ..... 40/124.08, 124.14, 124.15, 124.16, 40/124.17, 124.18, 120; 248/472, 459
See application file for complete search history.

(56) References Cited

U.S. PATENT DOCUMENTS

| | | | | | |
|---|---|---|---|---|---|
| 2,472,166 | A | | 6/1949 | Mathewson | |
| 3,013,359 | A | * | 12/1961 | Cross | B42D 5/043 248/459 |
| 3,305,206 | A | * | 2/1967 | Nichols | A47B 23/043 248/459 |
| 5,943,800 | A | * | 8/1999 | Rose | G09F 1/06 40/124.08 |
| 8,656,616 | B2 | * | 2/2014 | Ashpole | B42D 15/02 273/317.5 |
| 2003/0145499 | A1 | * | 8/2003 | Tarter | G09F 15/0062 40/610 |
| 2005/0156427 | A1 | * | 7/2005 | Best | G09F 1/06 283/56 |

OTHER PUBLICATIONS

The Extended European Search Report dated Apr. 5, 2018 for the related European Patent Application No. 16817415.9.

* cited by examiner

DISPLAY TOOL

This application is a U.S. national stage application of the PCT International Application No. PCT/JP2016/002646 filed on Jun. 1, 2016, which claims the benefit of foreign priority of Japanese patent application 2015-131697 filed on Jun. 30, 2015, the contents all of which are incorporated herein by reference.

TECHNICAL FIELD

The present disclosure relates to a display tool for showing information on a product or the like.

BACKGROUND ART

In a store or at an exhibition, a simplified display tool may be used. For example, the display tool is placed near a product or the like and used for, e.g., point-of-purchase advertisement on which a description of the product or the like is written. When a variety of products are on exhibit in a store, such a display tool plays an important role in making the products appealing.

For example, PTL 1 discloses a display tool called an erecting plate. The display tool is carried in its folded state, and the folded display tool is placed in a store or the like in its unfolded state.

CITATION LIST

Patent Literature

PTL 1: Japanese Unexamined Utility Model Publication No. 560-98474

SUMMARY OF THE INVENTION

The present disclosure provides a display tool that is easily erected from its folded state and that stably retains its shape after being erected.

The display tool of the present disclosure includes a display part, a back part, a stable part, a leg part, and a bottom part. The display part is disposed in its erected state. The back part has its upper edge connected to an upper edge of the display part and is disposed behind the display part such that a distance between the back part and the display part gradually increases from the upper edges to lower edges of the back part and the display part. The stable part protrudes downwardly along the back part from a portion of the lower edge of the back part. The leg part protrudes downward direction from remaining portion of the lower edge of the back part at an angle less than an angle at which the back part slants. The bottom part is connected to a lower edge of the display part and to a lower edge of the leg part. The stable part is disposed such that a lower edge of the stable part is in abutment with an upper surface of the bottom part.

The display tool of the present disclosure can be easily erected from its folded state and can stably retain its shape after being erected.

DESCRIPTION OF EMBODIMENTS (Details of Disadvantages)

Figure 1:
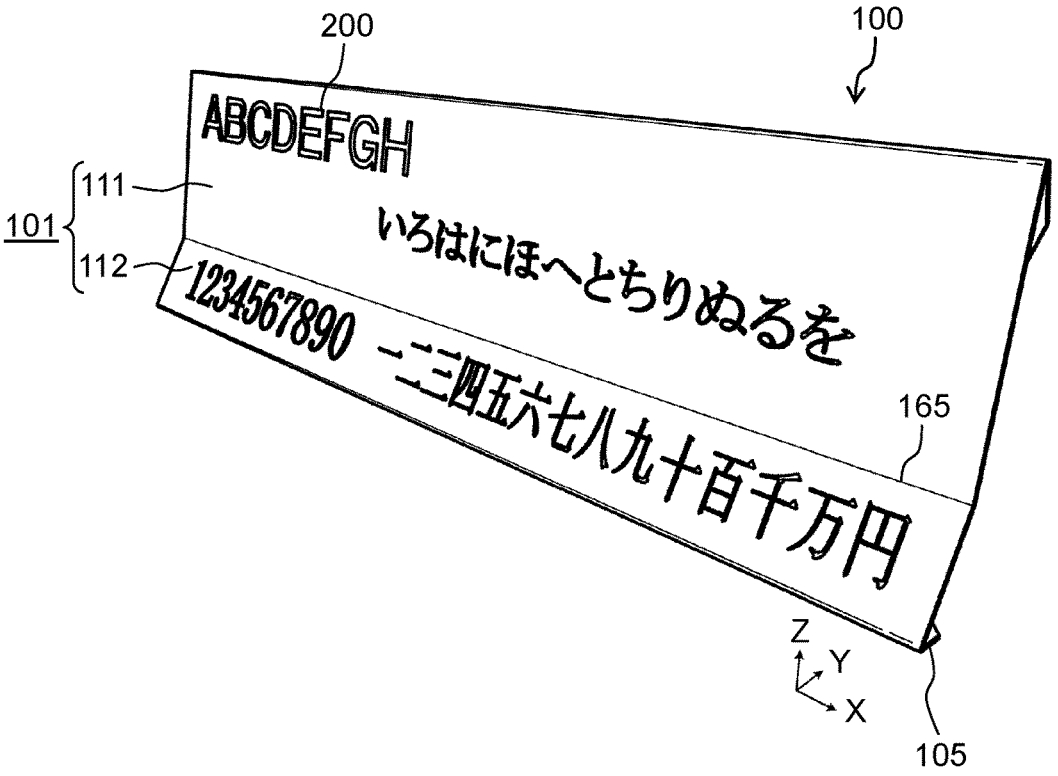
FIG. 1 is a front perspective view schematically illustrating an example of a display tool according to a first exemplary embodiment.

It takes much trouble to erect a conventional display tool from its folded state, making it quite burdensome to place the conventional display tool. Additionally, the conventional display tool may have difficulty retaining its shape due to creases when the conventional display tool is in its erected state. For the above reasons, the conventional display tool is often placed in a store in its folded state without being erected, and may fail to provide a successful customer appeal as a display tool.

First Exemplary Embodiment

Exemplary embodiments of the display tool according to the present disclosure are now described with reference to the accompanying drawings. It should be noted that unnecessarily detailed descriptions may not be provided. For example, a detailed description of a well-known matter, a description of a structure substantially identical to a structure already described, or the like may not be provided. This is intended to avoid unnecessary redundancy in the description below and to thus aid in the understanding of a person skilled in the art.

It should be noted that each of the exemplary embodiments below merely illustrates an example of the display tool according to the present disclosure. Additionally, the accompanying drawings and the description below are provided to allow a person skilled in the art to fully understand the present disclosure and are not intended to limit the claimed subject matter. Accordingly, the present disclosure has its scope defined by the literal languages of the claims with reference to the exemplary embodiments below and is not limited only to the exemplary embodiments below. Therefore, of the components in the following exemplary embodiments, the components not recited in the independent claim that defines the most generic concept of the present disclosure are not necessary for achieving the object of the present disclosure, but are described as components constituting a preferred embodiment.

Further, the drawings are not necessarily strictly accurate. The drawings are schematic views to which enhancement, omission, and adjustment of a ratio are made as appropriate in order for the drawings to illustrate the present disclosure, and thus shapes, positional relationships, and ratios may differ from actual ones. In the drawings, identical reference numerals denote components substantially identical to each other, and a description may not be provided or may be simplified for the components substantially identical to the components already described.

[1-1. Structure]

FIG. 1 is a front perspective view schematically illustrating an example of display tool 100 according to the first exemplary embodiment.

Figure 2:
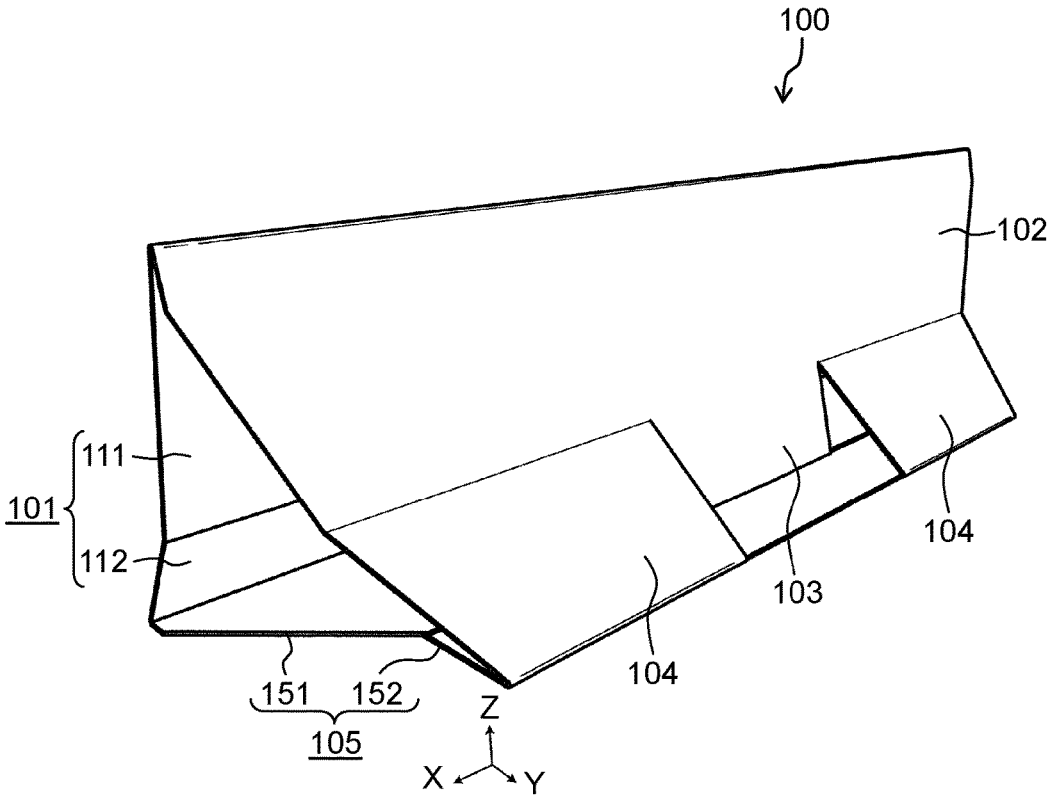
FIG. 2 is a back perspective view schematically illustrating the example of the display tool according to the first exemplary embodiment.

FIG. 2 is a back perspective view schematically illustrating the example of display tool 100 according to the first exemplary embodiment.

Figure 3:
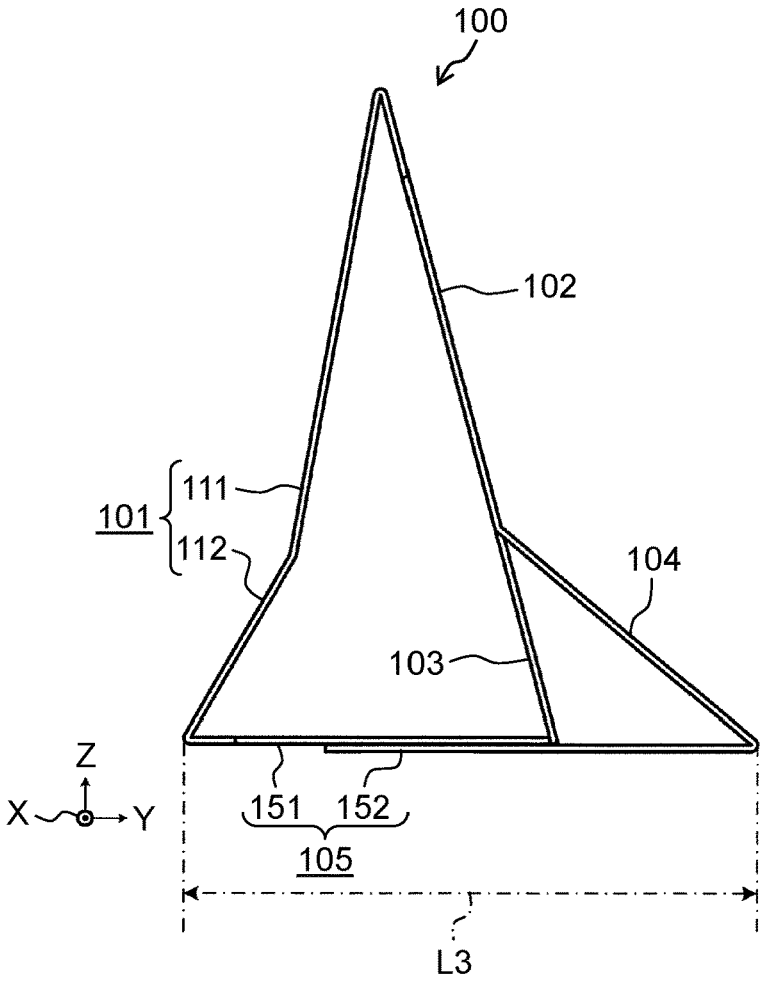
FIG. 3 is a side plan view schematically illustrating the example of the display tool according to the first exemplary embodiment.

FIG. 3 is a side plan view schematically illustrating the example of display tool 100 according to the first exemplary embodiment.

As illustrated in FIGS. 1 to 3, display tool 100 is an object placed near or on a product (not shown) to show information or the like on the product in a viewable manner. Display tool 100 includes display part 101, back part 102, stable part 103, leg parts 104, and bottom part 105.

Display part 101 is a part where at least its surface shows information such as characters, signs, pictures, and photographs. It should be noted that information shown on display part 101 illustrated in FIG. 1 is merely an example, and that in a store or the like, display part 101 shows information or the like on a product. Display part 101 is a part that is disposed in its erected state at the front side of display tool 100 (i.e., a side at which the information or the like are shown to a customer or the like). Other than a state in which display part 101 is erected at right angles (90°) to a placement surface (i.e., a surface on which display tool 100 is placed), the erected state includes a state in which display part 101 faces obliquely upward at angles of 45° or more and less than 90° with respect to the placement surface and a state in which display part 101 faces obliquely downward at angles of more than 90° and 120° or less with respect to the placement surface.

In this exemplary embodiment, display part 101 includes first display part 111 and second display part 112. First display part 111 is connected to back part 102. Second display part 112 is connected to bottom part 105. A direction of a surface (i.e., an angle of inclination with respect to the placement surface) of second display part 112 is different from a direction of a surface of first display part 111. First display part 111 and second display part 112 are connected to each other via auxiliary valley fold line 165, and the connection portion between first display part 111 and second display part 112 protrudes inwardly (i.e., inward direction of display tool 100; see FIG. 3).

Display part 101 is thus formed by two surfaces facing in opposite directions. This structure enables display tool 100 to attract a greater interest of people who take a look at display tool 100 (i.e., a viewer such as a customer). Additionally, for example, first display part 111 and second display part 112 may show different categories of information, which can make a stronger impression on a viewer.

First display part 111 and the second display part 112 may be connected to each other via an auxiliary mountain fold line, and the connection portion between first display part 111 and the second display part 112 may protrude outwardly (i.e., outward direction of display tool 100).

Back part 102 is a part that supports an upper edge of display part 101. Back part 102 is a part that has its upper edge connected to the upper edge of display part 101 and is disposed behind display part 101 such that a distance between back part 102 and display part 101 gradually increases from the upper edges to lower edges of back part 102 and display part 101.

In this exemplary embodiment, display part 101 and back part 102 are connected to each other via second mountain fold line 162 (see FIG. 5) so as to be unfoldable, and the connection portion between display part 101 and back part 102 protrudes outwardly (i.e., outward direction of display tool 100; see FIG. 3).

Stable part 103 is a part that protrudes downward direction along back part 102 from a portion of the lower edge of back part 102. A lower edge of stable part 103 is disposed in abutment with an upper surface of bottom part 105. Since the lower edge of stable part 103 is in abutment with bottom part 105, stable part 103 can solidly support the upper edge of display part 101 via back part 102. Thus, display tool 100 can stably keep a shape and an erected state of display part 101.

In this exemplary embodiment, stable part 103 is integrated with back part 102 and is substantially the same plane (flush) with back part 102.

Leg parts 104 is a part that protrude downward direction from the remaining portions of the lower edge of back part 102 at an angle less than an angle at which back part 102 slants, the remaining portions being where a part excepting for a part that stable part 103 is provided. In this exemplary embodiment, a width of stable part 103 is set less than a width of back part 102. Stable part 103 is provided around the center of the lower edge of back part 102. Leg part 104 is provided on both sides of stable part 103 (on both sides of stable part 103 in a width direction).

Bottom part 105 is a part that is in contact with a placement surface such as an upper surface of a table and an upper surface of a product when display tool 100 is placed on the table or the product. Bottom part 105 is a part that is connected to the lower edge of display part 101 (second display part 112) and connected to lower edges of leg parts 104.

In this exemplary embodiment, display part 101 (second display part 112) and bottom part 105 are connected to each other via third mountain fold line 163 (see FIG. 5) so as to be unfoldable, and the connection portion between display part 101 (second display part 112) and bottom part 105 protrudes outwardly (i.e., outward direction of display tool 100; see FIG. 3). Leg parts 104 and bottom part 105 are connected to each other via first mountain fold line 161 (see FIG. 5) so as to be unfoldable, and the connection portion between leg parts 104 and bottom part 105 protrudes outwardly (i.e., outward direction of display tool 100; see FIG. 3).

Bottom part 105 includes first bottom part 151 and second bottom part 152. First bottom part 151 is connected to the lower edge of display part 101 (second display part 112) via third mountain fold line 163 and is disposed in a state of extending in a direction toward leg parts 104 (see FIG. 3). Second bottom part 152 is connected to the lower edges of leg parts 104 via first mountain fold line 161, and disposed in a state of extending in a direction toward display part 101 and overlapping a lower side of first bottom part 151 (see FIG. 3). The overlapped portions of first bottom part 151 and second bottom part 152 are connected to each other using a connecting member (see FIG. 3). Examples of the connecting member include an adhesive, a double-sided tape, a grommet, and a stapler. The connecting member is only required to be able to connect first bottom part 151 to second bottom part 152 chemically or physically. In this exemplary embodiment, the connecting member is not particularly limited.

The structure of bottom part 105 can increase a weight of bottom part 105, and can allow display tool 100 to be placed on a placement surface with stability.

Thus, display tool 100 is shaped like a polygonal ring such that the respective folds correspond to vertexes of the polygonal ring.

A lower edge area of stable part 103 abuts an edge of first bottom part 151 (see FIG. 3), and the lower edge of stable part 103 abuts an upper surface of second bottom part 152 (see FIG. 3).

The lower edge area of stable part 103 is an area that includes the lower edge of stable part 103 and a portion proximate the lower edge of stable part 103. The edge refers to a portion at an edge.

As described above, back part 102 and leg parts 104 are connected to each other via first valley fold line 164 (see FIG. 5) so as to unfoldable, and the connection portion between back part 102 and leg parts 104 protrudes inwardly (i.e., inward direction of display tool 100; see FIG. 3). Leg parts 104 and second bottom part 152 are connected to each other via first mountain fold line 161 (see FIG. 5) so as to be unfoldable. Back part 102 and leg parts 104 are connected to each other so as to protrude inwardly (i.e., inward direction of display tool 100; see FIG. 3). Leg parts 104 and second bottom part 152 are connected to each other so as to protrude outwardly (i.e., outward direction of display tool 100; see FIG. 3).

The above structures and a biasing force due to so-called creases at the connection portions between the respective components enables leg parts 104 to push stable part 103 downward via back part 102. On the other hand, stable part 103 is less prone to be displaced because stable part 103 engages a step which is formed as a result of first bottom part 151 overlapping second bottom part 152 (see FIG. 3). Thus, a portion from the step of bottom part 105 to leg parts 104, leg parts 104, and stable part 103 form a triangle under a tension working (see FIG. 3). Accordingly, display tool 100 can retain its entire shape with stability in its erected state.

Figure 5:
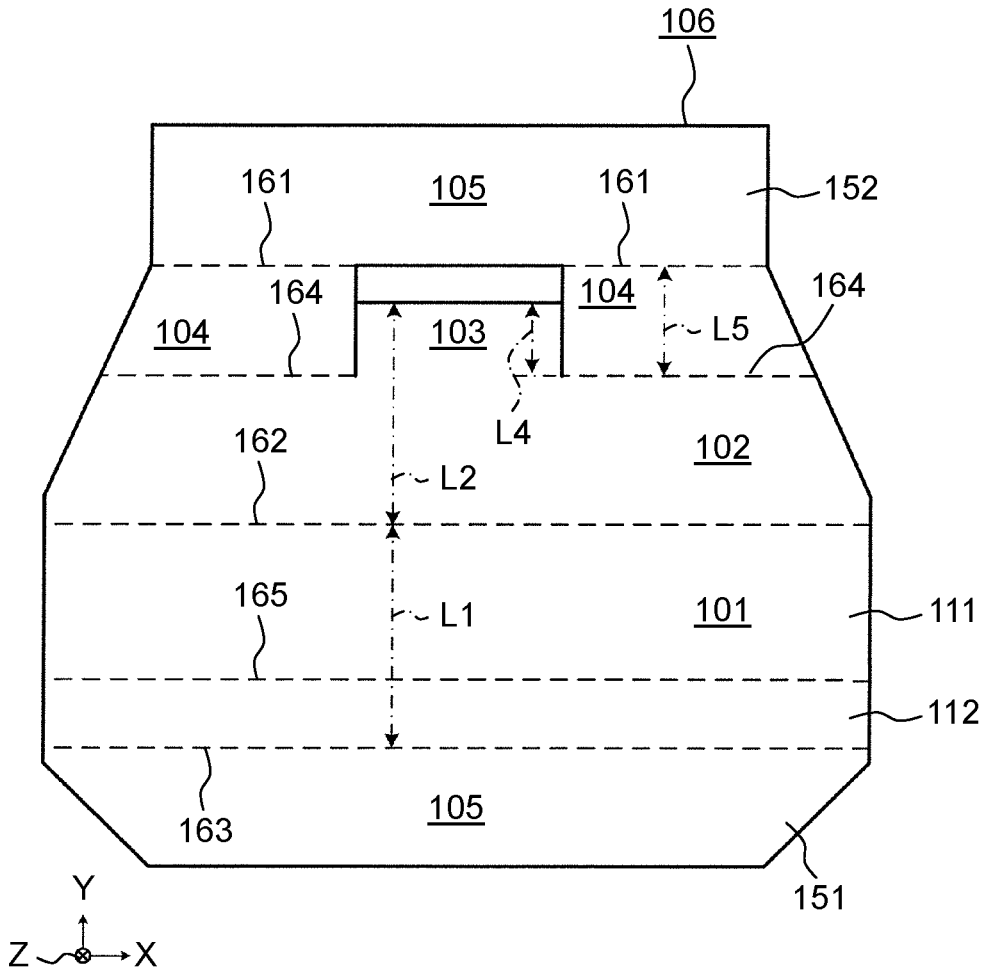
FIG. 5 is a plan view schematically illustrating an example of a basic member to be base to form the display tool according to the first exemplary embodiment.

In display tool 100 shown in this exemplary embodiment, L1, which is a length from the upper edge to the lower edge of display part 101 (see FIG. 5), is set greater than or equal to L2, which is the sum of a length from the upper edge to the lower edge of back part 102 and a length from an upper edge to the lower edge of stable part 103 (see FIG. 5). L3, which is a length from the lower edge of display part 101 at the bottom part 105 (i.e., the lower edge of second display part 112) to the lower edges of leg parts 104 (see FIG. 3), is set greater than or equal to L4+L5, which is the sum of L4, which is a length from the upper edge to the lower edge of stable part 103, and L5, which is a length from the upper edge to the lower edge of leg part 104 (see FIG. 5). L5 is set greater than L4 (see FIG. 5).

Figure 4:
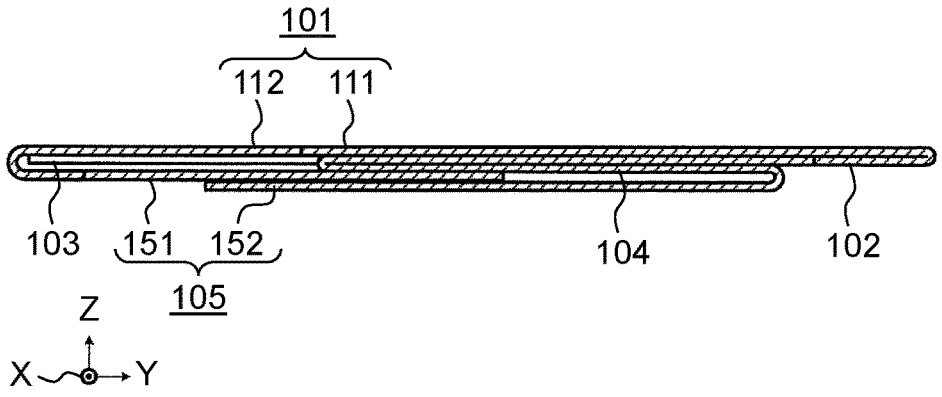
FIG. 4 is a side cross-sectional view schematically illustrating the example of the display tool according to the first exemplary embodiment, the display tool being in its folded state.

FIG. 4 is a side cross-sectional view schematically illustrating the example of display tool 100 according to the first exemplary embodiment, the display tool being in its folded state.

Since the respective sizes of display tool 100 are set to have the above-described relationship, erected display tool 100 can be folded to a substantially flat state as illustrated in FIG. 4 while the ring shape of display tool 100 is maintained, when display tool 100 erected is folded.

This structure allows display tool 100 to be carried in its folded state together with a product or the like. This saves space taken by display tool 100 being carried. When display tool 100 is used, a bending, a gluing or the like are not required, allowing a user to easily erect display tool 100. Additionally, display tool 100 in its erected state can retain its shape with stability.

FIG. 5 is a plan view schematically illustrating an example of basic member 106 to be base to form display tool 100 according to the first exemplary embodiment.

In the description below, X axis, Y axis, and Z axis are used as necessary. The X axis corresponds to an axis parallel to a width direction of basic member 106, the Z axis corresponds to an axis parallel to a thickness direction of basic member 106, the Y axis corresponds to an axis orthogonal to each of the X axis and the Z axis.

As illustrated in FIG. 5, basic member 106 is a member that is shaped like a thin plate. A material of basic member 106, that is, a material of display tool 100 is not limited to any particular material. In this exemplary embodiment, a cardboard, which is a tear-resistant paper, is taken as an example of the material of basic member 106 (i.e., the material of display tool 100). The material of basic member 106 may be a composite material such as a material made by adhering a resin film to a surface of a paper, and a material coated with resin. Alternatively, the material of basic member 106 may be a thin plate of metal, a resin film or the like.

At a lower end of basic member 106 (i.e., a lower side in FIG. 5), first bottom part 151 is disposed throughout basic member 106 in the width direction (i.e., the X axis direction illustrated in FIG. 5). First bottom part 151 may have a trapezoid shape such that one side of first bottom part 151, the one side being connected to second display part 112 of display part 101, has a length greater than a length of the other side opposite the one side.

Display part 101 is disposed throughout basic member 106 in the width direction (i.e., the X axis direction), with one side of display part 101 (i.e., one side of second display part 112) being connected to first bottom part 151 via third mountain fold line 163. In display part 101, the other side of second display part 112, the other side being opposite the one side of second display part 112, is connected to first display part 111 via auxiliary valley fold line 165. First display part 111 and second display part 112 may each have a rectangular shape so that display part 101 has a rectangular shape. First display part 111 may be larger in size than second display part 112.

Back part 102 is disposed throughout basic member 106 in the width direction (i.e., the X axis direction), with one side of back part 102 being connected to display part 101 (first display part 111) via second mountain fold line 162. Back part 102 may have a trapezoid shape such that the one side of back part 102, the one side being connected to first display part 111, has a length greater than a length of the other side of back part 102, the other side being opposite the one side of back part 102.

Stable part 103 is connected to a center portion of the other side of back part 102, the other side being opposite the one side of back part 102, the one side being connected to first display part 111, so as to be the same plane (flush) with back part 102. A width of stable part 103 (i.e., a length of stable part 103 in the X axis direction) is less than a width of back part 102 (i.e., the length of the other side of back part 102) so as to allow leg parts 104 to be provided on both sides of stable part 103. Stable part 103 may be a part of back part 102. Stable part 103 may have a rectangular shape.

Two leg parts 104 are connected to the other side of back part 102 via first valley fold line 164, the other side being opposite the one side of back part 102, the one side being connected to first display part 111 of back part 102. That is, two leg parts 104 are connected to both sides of stable part 103 at the other side of back part 102, so that stable part 103 is sandwiched between two leg parts 104. Leg parts 104 may have a trapezoid shape such that the one side of leg part 104, the one side being connected to back part 102, has a length greater than a length of the other side of leg part 104, the other side being opposite the one side of leg part 104.

In basic member 106, leg part 104, stable part 103, and leg part 104 are arranged in this order in the width direction (i.e., the X axis direction), and stable part 103 and two leg parts 104 are divided from each other by a cut.

One side of second bottom part 152 is connected to leg parts 104 via first mountain fold line 161. Second bottom part 152 may have a rectangular shape.

Display tool 100 of this exemplary embodiment is formed by folding basic member 106 having the above structure along the mountain fold lines and the valley fold lines and overlapping first bottom part 151 with second bottom part 152 with the use of a connecting member.

[1-2. Advantageous Effects or the Like]

In this exemplary embodiment, a display tool includes a display part, a back part, a stable part, leg parts, and a bottom part, as described above. The display part is disposed in its erected state. The back part has its upper edge connected to an upper edge of the display part and is disposed behind the display part such that a distance between the back part and the display part gradually increases from the upper edges to lower edges of the back part and the display part. The stable part protrudes downwardly along the back part from a portion of the lower edge of the back part. The leg parts protrude downward direction from the remaining portions of the lower edge of the back part at an angle less than an angle at which the back part slants. The bottom part is connected to the lower edge of the display part and to lower edges of the leg parts. The stable part is disposed such that a lower edge of the stable part is in abutment with an upper surface of the bottom part.

Display tool 100 is an example of the display tool. Display part 101 is an example of the display part. Back part 102 is an example of the back part. Stable part 103 is an example of the stable part. Leg part 104 is an example of the leg part. Bottom part 105 is an example of the bottom part. The remaining portions of the lower edge of back part 102, the remaining portions being where a part excepting for a part that stable part 103 is disposed, are an example of the remaining portions of the lower edge of the back part.

For example, in the example according to the first exemplary embodiment, display tool 100 includes display part 101, back part 102, stable part 103, leg parts 104, and bottom part 105. Display part 101 is disposed in an erected state. Back part 102 has its upper edge connected to the upper edge of display part 101 and is disposed behind display part 101 such that a distance between back part 102 and display part 101 gradually increases from the upper edges to the lower edges of back part 102 and display part 101. Stable part 103 protrudes downwardly along back part 102 from a portion of the lower edge of back part 102. Leg parts 104 protrude downward direction from the remaining portions of the lower edge of back part 102 at an angle less than an angle at which back part 102 slants, the remaining portions being where a part excepting for a part that stable part 103 is provided. Bottom part 105 is connected to the lower edge of display part 101 and to the lower edges of leg parts 104. Stable part 103 is disposed such that the lower edge of stable part 103 is in abutment with the upper surface of bottom part 105.

In the display tool, the display part and the back part, the display part and the bottom part, and the leg parts and the bottom part may be connected to each other such that each of connection portions between the respective pairs of the components protrudes outwardly. The back part and the leg parts may be connected to each other such that a connection portion between the back part and the leg parts protrudes inwardly.

For example, in the example according to the first exemplary embodiment, in display tool 100, display part 101 and back part 102, display part 101 and bottom part 105, and leg parts 104 and bottom part 105 are connected to each other such that each of the connection portions between the respective pairs of the components protrudes outwardly. Back part 102 and leg parts 104 are connected to each other such that the connection portion between back part 102 and leg parts 104 protrudes inwardly.

In the display tool, the bottom part may include a first bottom part and a second bottom part. The first bottom part may be connected to the lower edge of the display part and disposed in a state of extending in a direction toward the leg parts. The second bottom part may be connected to the lower edges of the leg parts and disposed in a state of extending in a direction toward the display part and overlapping a lower side of the first bottom part. The lower edge area of the stable part may abut an edge of the first bottom part and the lower edge of the stable part may abut an upper surface of the second bottom part.

First bottom part 151 is an example of the first bottom part. Second bottom part 152 is an example of the second bottom part.

For example, in the example according to the first exemplary embodiment, in display tool 100, bottom part 105 includes first bottom part 151 and second bottom part 152. First bottom part 151 is connected to the lower edge of display part 101 and disposed in a state of extending in the direction toward leg part 104. Second bottom part 152 is connected to the lower edges of leg parts 104 and disposed in a state of extending in the direction toward display part 101 and overlapping the lower side of first bottom part 151. The lower edge area of stable part 103 abuts the edge of first bottom part 151 and the lower edge of stable part 103 abuts the upper surface of second bottom part 152.

In the display tool, the display part may include a first display part and a second display part. The first display part may be connected to the back part. The second display part may be connected to the bottom part. A direction of a surface of the second display part may be different from a direction of a surface of the first display part.

It should be noted that first display part 111 is an example of the first display part. Second display part 112 is an example of the second display part.

For example, in the example according to the first exemplary embodiment, in display tool 100, display part 101 includes first display part 111 and second display part 112. First display part 111 is connected to back part 102. Second display part 112 is connected to bottom part 105. The direction of the surface of second display part 112 is different from the direction of the surface of first display part 111.

In the display tool, the display part and the back part, the back part and the leg parts, the display part and the bottom part, and the leg parts and the bottom part may be connected to each other such that the respective pairs of the components are unfoldable. A length from the upper edge to the lower edge of the display part may be greater than or equal to the sum of a length from the upper edge to the lower edge of the back part and a length from the upper edge to the lower edge of the stable part.

It should be noted that L1, which is the length from the upper edge to the lower edge of display part 101, is an example of the length from the upper edge to the lower edge of the display part. L2, which is the sum of the length from the upper edge to the lower edge of back part 102 and the length from the upper edge to the lower edge of stable part 103, is an example of the sum of the length from the upper edge to the lower edge of the back part and the length from the upper edge to the lower edge of the stable part.

For example, in the example according to the first exemplary embodiment, in display tool 100, display part 101 and back part 102, back part 102 and leg parts 104, display part 101 and bottom part 105, and leg parts 104 and bottom part 105 are connected to each other such that the respective pairs of the components are unfoldable. L1, which is the length from the upper edge to the lower edge of display part 101 is greater than or equal to L2, which is the sum of the length from the upper edge to the lower edge of back part 102 and the length from the upper edge to the lower edge of stable part 103.

In the display tool, a length of the bottom part from the display part to the leg parts may be greater than or equal to the sum of the length from the upper edge to the lower edge of the stable part and a length from the upper edge to the lower edges of the leg parts.

It should be noted that L3, which is the length of bottom part 105 from the lower edge of display part 101 (i.e., the lower edge of second display part 112) to the lower edge of leg part 104, is an example of the length of the bottom part from the display part to the leg parts. L4, which is the length from the upper edge to the lower edge of stable part 103, is an example of the length from the upper edge to the lower edge of the stable part. L5, which is the length from the upper edge to the lower edge of leg part 104, is an example of the length from the upper edge to the lower edge of the leg part.

For example, in display tool 100 according to the example in the first exemplary embodiment, L3, which is the length of bottom part 105 from the lower edge of display part 101 (i.e., the lower edge of second display part 112) to the lower edge of leg part 104, is greater than or equal to the sum of L4+L5, which is the sum of L4, which is the length from the upper edge to the lower edge of stable part 103 and L5, which is the length from the upper edge to the lower edge of leg part 104.

In part of one basic member shaped like a thin plate, the display part may be disposed in a state of extending in a width direction; the back part may be connected to the display part via a mountain fold line; the stable part may be connected to a portion of the back part disposed on an opposite side of the display part; the leg parts may be connected, via a valley fold line, to the remaining portions of the back part disposed on the opposite side of the display part; the stable part and the leg parts, which are aligned in the width direction of the basic member, may be divided from each other; and the bottom part may be connected to at least one of the leg parts and the display part via a mountain fold line. The display tool may be formed by folding the basic member at the mountain fold lines and the valley fold line.

Basic member 106 is an example of the basic member. Each of first mountain fold line 161, second mountain fold line 162, and third mountain fold line 163 is example of the mountain fold line. First valley fold line 164 is an example of the valley fold line.

For example, in the example according to the first exemplary embodiment, in part of basic member 106, which is shaped like a thin plate, display part 101 is disposed in a state of extending in the width direction. Back part 102 is connected to display part 101 via second mountain fold line 162. Stable part 103 is connected to a portion of back part 102 disposed on the opposite side of display part 101. Leg parts 104 are connected to the remaining portions of back part 102 disposed on the opposite side of display part 101 (the remaining portions being at the lower edge of back part 102 and being where a part excepting for a part that stable part 103 is provided) via first valley fold line 164. Stable part 103 and leg parts 104, which are aligned in the width direction of basic member 106, are mutually divided. Bottom part 105 is connected to leg parts 104 via first mountain fold line 161 and connected to display part 101 via third mountain fold line 163. Display tool 100 is formed by folding basic member 106 at the mountain fold lines and the valley fold line.

This allows display tool 100 to be easily constructed of basic member 106. Thus, display tool 100 can be easily constructed at low cost.

Other Exemplary Embodiments

As described above, the first exemplary embodiment has been described as an example of the technique disclosed in this application. However, the present disclosure is not limited to the first exemplary embodiment. For example, another possible exemplary embodiment of the present disclosure may be realized by combining the components in this description as appropriate or by eliminating some of the components. Further, the present disclosure includes modifications obtained by making, to the first exemplary embodiment, various changes conceived by a person skilled in the art unless the various changes depart from the spirit of the present disclosure, that is, the meanings of the literal languages of the claims.

Other exemplary embodiments are now described as examples.

For example, in the first exemplary embodiment, the exemplary structure in which basic member 106 includes first bottom part 151 and second bottom part 152, which are divided from each other, has been described. However, the present disclosure is not limited to this structure. For example, basic member 106 may include bottom part 105 formed of a single component.

In the first exemplary embodiment, the exemplary structure in which first bottom part 151 and second bottom part 152 are connected to each other such that first bottom part 151 overlaps with second bottom part 152 has been described, but the present disclosure is not limited to this structure. For example, two portions of display tool 100 may be butt-joined.

In the first exemplary embodiment, the exemplary structure in which display tool 100 is constructed of basic member 106 has been described, but the present disclosure is not limited to this structure. For example, display tool 100 may be formed by connecting components corresponding to display part 101, back part 102 and the like with the use of a flexible connecting means. In the first exemplary embodiment, the exemplary structure in which leg part 104 is provided at two portions of the lower edge of back part 102 has been described, but the present disclosure is not limited to this structure. For example, in display tool 100, leg part 104 may be provided at a portion or at three portions or more.

In the first exemplary embodiment, the exemplary structure in which stable part 103 is provided at a portion of the lower edge of back part 102 has been described, but the present disclosure is not limited to this structure. For example, in display tool 100, stable part 103 may be provided at a plurality of portions.

In the first exemplary embodiment, the exemplary structure in which first bottom part 151 overlaps with second bottom part 152 has been described, but the present disclosure is not limited to this structure. For example, in display tool 100, a portion of bottom part 105, which is flush, may be lanced and the lanced portion may abut the lower edge of stable part 103.

Each of display part 101, back part 102, stable part 103, and leg part 104 does not need to be flattened, but may be curved instead.

The exemplary embodiments have been described as examples of the technique in this disclosure. Therefore, the accompanying drawings and the detailed description are provided.

Accordingly, the components illustrated in the accompanying drawings and described in the detailed description may include not only components necessary for overcoming the disadvantages, but also components which are unnecessary for overcoming the disadvantages but are provided for illustrating the above techniques. Therefore, the unnecessary components illustrated in the accompanying drawings and described in the detailed description should not be instantly acknowledged to be necessary components.

The above exemplary embodiments are intended to illustrate the techniques of the present disclosure, and thus various changes, replacements, additions, omissions or the like can be made within the scope of the claims or in a scope equivalent thereto.

INDUSTRIAL APPLICABILITY

The present disclosure is applicable to a display tool, which may be used in a store or at an exhibition for showing information on a product or the like.

REFERENCE MARKS IN THE DRAWINGS

100 display tool
101 display part
102 back part
103 stable part
104 leg part
105 bottom part
106 basic member
111 first display part
112 second display part
151 first bottom part
152 second bottom part
161 first mountain fold line
162 second mountain fold line
163 third mountain fold line
164 first valley fold line
165 auxiliary valley fold line

The invention claimed is:

1. A display tool comprising:

a display part disposed in an erected state;

a back part that has an upper edge connected to an upper edge of the display part and that is disposed behind the display part such that a distance between the back part and the display part gradually increases from the upper edges to lower edges of the back part and the display part;

a stable part protruding downwardly along the back part from a portion of the lower edge of the back part;

a leg part protruding downward direction from remaining portion of the lower edge of the back part at an angle less than an angle at which the back part slants; and a bottom part connected to a lower edge of the display part and to a lower edge of the leg part, wherein a lower edge of the stable part is provided in abutment with an upper surface of the bottom part.

2. The display tool according to claim 1, wherein the display part and the back part are connected to each other so as to protrude outwardly, the display part and the bottom part are connected to each other so as to protrude outwardly, and the leg part and the bottom part are connected to each other so as to protrude outwardly, and the back part and the leg part are connected to each other so as to protrude inwardly.

3. The display tool according to claim 1, wherein the bottom part includes a first bottom part connected to the lower edge of the display part and disposed to extend in a direction toward the leg part, and a second bottom part connected to the lower edge of the leg part and disposed to extend in a direction toward the display part and overlap a lower side of the first bottom part, and a lower edge area of the stable part abuts an edge of the first bottom surface, and the lower edge of the stable part abuts an upper surface of the second bottom part.

4. The display tool according to claim 1, wherein the display part includes a first display part connected to the back part, and a second display part connected to the bottom part and having a surface facing a direction different from a direction that a surface of the first display part faces.

5. The display tool according to claim 1, wherein the display part and the back part are connected to each other to be unfoldable, the back part and the leg part are connected to each other to be unfoldable, the display part and the bottom part are connected to each other to be unfoldable, and the leg part and the bottom part are connected to each other to be unfoldable, and a length from the upper edge to the lower edge of the display part is greater than or equal to a sum of a length from the upper edge to the lower edge of the back part and a length from an upper edge to the lower edge of the stable part.

6. The display tool according to claim 1, wherein the display part and the back part are connected to each other to be unfoldable, the back part and the leg part are connected to each other to be unfoldable, the display part and the bottom part are connected to each other to be unfoldable, and the leg part and the bottom part are connected to each other to be unfoldable, a length from the upper edge to the lower edge of the display part is greater than or equal to a sum of a length from the upper edge to the lower edge of the back part and a length from an upper edge to the lower edge of the stable part, and a length of the bottom part from the display part to the leg part is greater than or equal to a sum of the length from the upper edge to the lower edge of the stable part and a length from an upper edge to the lower edge of the leg part.

7. The display tool according to claim 1, wherein in part of one basic member shaped like a thin plate, the display part is disposed to extend in a width direction, the back part is connected to the display part via a mountain fold line, the stable part is connected to a portion of the back part disposed on an opposite side of the display part, the leg part is connected, via a valley fold line, to the remaining portion of the back part disposed on the opposite side of the display part, the stable part and the leg part, which are aligned in a width direction of the basic member, are mutually divided, the bottom part is connected to at least one of the leg part and the display part via a mountain fold line, and the basic member is folded at the mountain fold lines and the valley fold line to form the display tool.

* * * * *